US010501218B1

(12) United States Patent
Keaton

(10) Patent No.: US 10,501,218 B1
(45) Date of Patent: Dec. 10, 2019

(54) MULTI-PURPOSE TOOL AND METHOD FOR SECURING A LOCKING FASTENER

(71) Applicant: Gerald B. Keaton, Jacksonville, FL (US)

(72) Inventor: Gerald B. Keaton, Jacksonville, FL (US)

( * ) Notice: Subject to any disclaimer, the term of this patent is extended or adjusted under 35 U.S.C. 154(b) by 63 days.

(21) Appl. No.: 16/023,506

(22) Filed: Jun. 29, 2018

Related U.S. Application Data

(62) Division of application No. 14/818,399, filed on Aug. 5, 2015, now Pat. No. 10,040,584.

(60) Provisional application No. 62/033,787, filed on Aug. 6, 2014.

(51) Int. Cl.

| | |
|---|---|
| ***B65B 13/02*** | (2006.01) |
| ***F21V 33/00*** | (2006.01) |
| ***B25B 31/00*** | (2006.01) |
| ***B25B 7/22*** | (2006.01) |
| ***B26B 17/00*** | (2006.01) |

(52) U.S. Cl.
CPC ..... *B65B 13/025* (2013.01); *B25B 7/22* (2013.01); *B25B 31/00* (2013.01); *B26B 17/00* (2013.01); *F21V 33/0084* (2013.01)

(58) Field of Classification Search
CPC ... B65B 13/025; F21V 33/0084; B26B 17/00; B25B 7/22; B25B 31/00; B25B 7/06; A45D 29/02; H02G 1/12
USPC ..... 7/168, 170, 125, 81, 118, 127–132
See application file for complete search history.

(56) References Cited

U.S. PATENT DOCUMENTS

| | | | | |
|---|---|---|---|---|
| 680,030 | A | 8/1901 | Emans | |
| 854,891 | A | 5/1907 | Huffman | |
| 2,212,013 | A | 8/1940 | Devareaux | |
| 2,320,967 | A | 6/1943 | Dukenberger | |
| 2,947,564 | A | 8/1960 | Winther | |
| 3,171,193 | A | 3/1965 | Bowden | |
| 3,206,844 | A | 9/1965 | Bowden | |
| 3,824,165 | A | 7/1974 | Miranda | |
| 3,857,592 | A | 12/1974 | Koike | |
| 4,331,257 | A * | 5/1982 | Taschner | A61L 2/26 220/214 |
| 4,528,751 | A | 7/1985 | Olson | |
| 5,089,007 | A | 2/1992 | Kirsch | |
| 5,177,847 | A | 1/1993 | Ottone | |
| 5,199,419 | A | 4/1993 | Remiszewski | |
| 5,313,376 | A | 5/1994 | McIntosh | |
| 5,338,317 | A | 8/1994 | Hasson | |
| 5,432,968 | A | 7/1995 | Beck | |
| 5,573,329 | A | 11/1996 | Van Gennep | |
| D376,967 | S | 12/1996 | Fuller | |
| 5,642,913 | A | 7/1997 | Brown | |
| 5,690,416 | A | 11/1997 | Van Gennep | |
| 5,765,251 | A | 6/1998 | Jones | |

(Continued)

*Primary Examiner* — Ryan J. Walters
*Assistant Examiner* — Lawrence Averick
(74) *Attorney, Agent, or Firm* — Allen Dyer Doppelt & Gilchrist

(57) ABSTRACT

Disclosed is a multi-purpose tool having two elongated handles and a head portion pivotably connected about a common pivot joint. A flexible tubular element is connected to one of the two elongated handles. A gripping element is housed within a distal end of the tubular element. The gripping element can be extended or retracted from the distal end of the tubular element. A lighting element is attached to the distal end of the tubular element to illuminate working area.

8 Claims, 10 Drawing Sheets

(56) References Cited

U.S. PATENT DOCUMENTS

| | | | | |
|---|---|---|---|---|
| 5,937,498 | A | 8/1999 | Ploeger | |
| 6,088,860 | A | 7/2000 | Poehlmann | |
| 6,119,561 | A | 9/2000 | Anderson | |
| 6,182,541 | B1 | 2/2001 | Anderson | |
| 6,220,127 | B1 | 4/2001 | Berg | |
| 6,226,822 | B1 | 5/2001 | Chen | |
| 6,257,106 | B1 | 7/2001 | Anderson | |
| 6,283,434 | B1 | 9/2001 | Holder | |
| 6,312,138 | B1 | 11/2001 | Coleman, Jr. | |
| 6,315,340 | B1 | 11/2001 | Chen | |
| 6,341,423 | B1 | 1/2002 | Taggart | |
| 6,408,522 | B2 | 6/2002 | Rivera | |
| 6,430,797 | B1 | 8/2002 | Dittmar | |
| 6,592,602 | B1 | 7/2003 | Peartree | |
| 6,769,331 | B2 | 8/2004 | Berg | |
| 6,983,506 | B1 | 1/2006 | Brown | |
| 7,527,311 | B2 | 5/2009 | Shih | |
| 7,780,650 | B2 | 8/2010 | Frassica | |
| 7,913,591 | B2 | 3/2011 | Nenadic | |
| 8,092,489 | B2 | 1/2012 | Ewers | |
| 8,574,243 | B2 * | 11/2013 | Saadat | A61B 1/00135 606/139 |
| 8,828,027 | B2 | 9/2014 | Vaughan | |
| 9,234,379 | B2 * | 1/2016 | Togiya | G09F 3/03 |
| 2003/0187472 | A1 | 10/2003 | Peartree | |
| 2004/0162568 | A1 * | 8/2004 | Saadat | A61B 1/00135 606/139 |
| 2005/0075653 | A1 | 4/2005 | Saadat | |
| 2005/0096676 | A1 | 5/2005 | Gifford | |
| 2005/0200143 | A1 | 9/2005 | Maestas | |
| 2005/0251165 | A1 | 11/2005 | Vaughan | |
| 2007/0005041 | A1 | 1/2007 | Frassica | |
| 2007/0186351 | A1 | 8/2007 | Linn | |
| 2008/0262539 | A1 | 10/2008 | Ewers | |
| 2009/0076503 | A1 | 3/2009 | Bertolero | |
| 2010/0036380 | A1 | 2/2010 | Taylor | |
| 2010/0076264 | A1 | 3/2010 | Tallarida | |
| 2010/0122419 | A1 | 5/2010 | Zupancic-Albin | |
| 2010/0139007 | A1 | 6/2010 | Anderson | |
| 2010/0249814 | A1 | 9/2010 | Vaughan | |
| 2011/0307069 | A1 | 12/2011 | Frassica | |
| 2011/0319713 | A1 | 12/2011 | Frassica | |
| 2012/0004504 | A1 | 1/2012 | Frassica | |
| 2012/0010598 | A1 | 1/2012 | Frassica | |
| 2012/0130164 | A1 | 5/2012 | Palese | |
| 2012/0245604 | A1 | 9/2012 | Tegzes | |
| 2013/0104363 | A1 | 5/2013 | Allen | |
| 2013/0165754 | A1 | 6/2013 | Frassica | |
| 2013/0165856 | A1 | 6/2013 | Frassica | |
| 2013/0253537 | A1 | 9/2013 | Saadat | |
| 2013/0304095 | A1 | 11/2013 | Bamer | |
| 2014/0054912 | A1 | 2/2014 | Bustos | |
| 2014/0064820 | A1 | 3/2014 | Mach | |
| 2015/0008148 | A1 | 1/2015 | Shelton | |
| 2015/0062876 | A1 | 3/2015 | Brauner | |
| 2015/0183105 | A1 | 7/2015 | Keng | |
| 2015/0196311 | A1 | 7/2015 | Chu | |
| 2017/0202609 | A1 | 7/2017 | Shelton, IV | |

* cited by examiner

MULTI-PURPOSE TOOL AND METHOD FOR SECURING A LOCKING FASTENER

CROSS-REFERENCE TO RELATED APPLICATION

This application is a divisional of U.S. patent application Ser. No. 14/818,399 filed on Aug. 5, 2015, which claims the benefit of U.S. Provisional Patent Application Ser. No. 62/033,787, filed on Aug. 6, 2014, the contents of which applications are herein incorporated by reference in their entirety.

FIELD OF THE INVENTION

The present invention generally relates to hand held tools, and more particularly to a multi-purpose tool and method for securing locking fasteners that are used to secure intermodal containers loaded onto the chassis of a truck.

BACKGROUND OF THE INVENTION

A typical intermodal container is a standardized steel box. These containers are used to move materials and products from ship, to rail, and to truck without unloading and reloading the contents of the container. A typical container has doors at one end, and at each of the corners there are castings for receiving locking fasteners. The locking fasteners are used to secure the container during handling and transit.

When the containers are transported by truck, the drivers are responsible to confirm that the bottom four corners of the container are properly secured to the chassis of the truck by locking fasteners. A locking fastener can include a locking rod that slides into an opening of the casting at the corner of the container and a locking lever that is forced down over a handle of the locking rod. The locking fastener can also be a twist lock that slides into a bottom opening of the casting and twists 90 degrees. In addition, drivers are required to secure each locking fastener in place with a zip tie to ensure that they will not jiggle loose. Often, a driver must secure a zip tie at night or in inclement weather. The tight confines of the locations of the locking fasteners make it difficult to confirm that a zip tie has been properly secured through a locking fastener. It is critical that a zip tie be properly secured to prevent the locking fastener from coming loose. If one or more corners of a container were to become loose, the container could slide laterally across and off the supporting chassis of the truck, causing significant damage. A shortcoming of the related prior art is the inefficiency and difficulty of installing the zip ties needed to ensure that that locking fasteners do not come loose. Accordingly, a multi-purpose tool for securing locking fasteners quickly and precisely in all conditions is needed. Despite significant recent advancements in this area, further improvements are possible.

SUMMARY OF THE INVENTION

In view of the foregoing, it is an object of the present invention to provide a multi-purpose tool and method for securing locking fasteners. In one embodiment, the multi-purpose tool includes two elongated handles connected about a common pivot joint and a head portion connected about the common pivot joint. The head portion includes a cutting tool. A flexible tubular element is connected to one of the two elongated handles. A gripping element is housed within a distal end of the tubular element. The gripping element can be extended or contracted from the distal end of the tubular element by a slide disposed on the elongated handle to which the tubular element is attached. A first lighting element is housed within the distal end of the flexible tubular element. A rotatable second lighting element is mounted on one of the two elongated handles.

Another embodiment of the present invention is directed to methods of securing locking fasteners using the disclosed multi-purpose tool. An example method includes inserting an end of a tie fastener (e.g., zip tie) through a first aperture disposed on a first side of a locking fastener (e.g., a locking lever), where the locking fastener (e.g., locking lever) is used to secure a locking rod of a truck in a locked position. The flexible tubular element of the multi-purpose tool is inserted through a second aperture disposed on a second side of locking fastener (e.g., locking lever). A user can manipulate (e.g., pushed forward) the slide of the multi-purpose tool to extend and open the gripping element outwardly from the distal end of the tubular element. The slide can also be manipulated (e.g. pushed backward) to close and grip on the end of the zip tie. The end of the tie fastener (e.g., zip tie) is pulled back through the second aperture to a desired position to form a closed loop around the locking fastener (e.g., locking lever). A cutting tool on the head portion of the multi-purpose tool is used to cut the tie fastener (e.g., zip tie) when needed.

BRIEF DESCRIPTION OF THE DRAWINGS

Features and benefits of the present invention will become apparent as the description proceeds when taken in conjunction with the accompanying drawings in which.

DETAILED DESCRIPTION OF PREFERRED EMBODIMENTS

Figure 1:
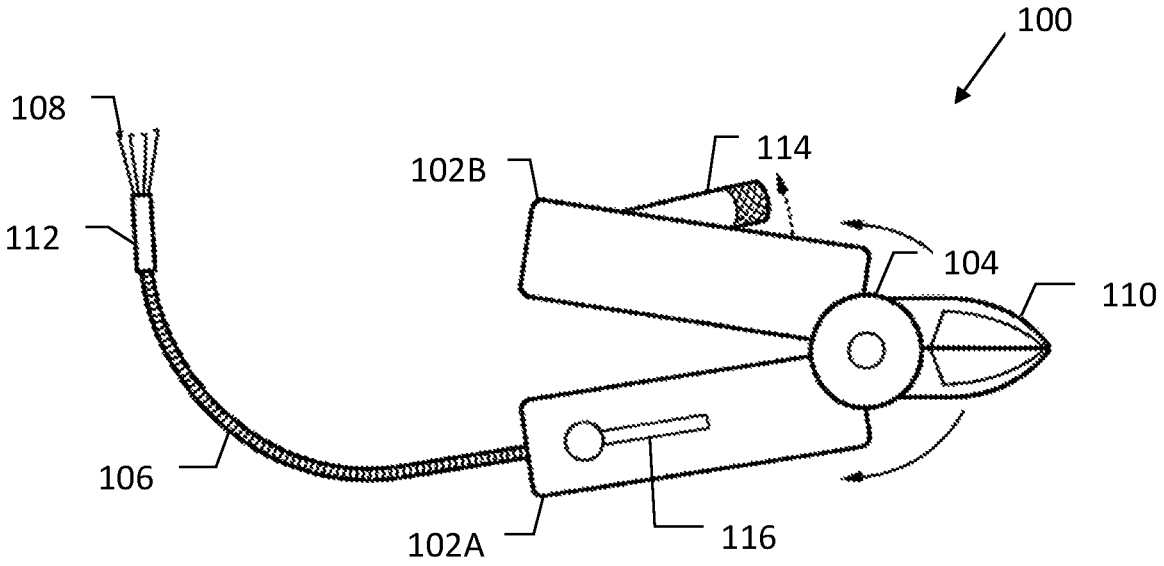
FIG. 1 is a top view of a multi-purpose tool in an unfolded state according to an embodiment of the present invention.

The present invention will now be described more fully hereinafter with reference to the accompanying drawings, in which various embodiments of the invention are shown. This invention can, however, be embodied in many different forms and should not be construed as limited to the embodiments set forth herein. Rather, these embodiments are provided so that this disclosure will be thorough and complete, and fully convey the scope of the invention to those skilled in the art. Like numbers refer to like elements throughout.

Referring now to FIGS. 1-8, the multi-purpose tool 100 includes two elongated handles 102A and 102B, which are connected about a common pivot joint 104. A flexible tubular element 106 is connected to the distal end of handle 102A. A gripping element 108 is housed within the distal end of the tubular element 106. A head portion 110 is connected about the common pivot joint 104.

Figure 2:
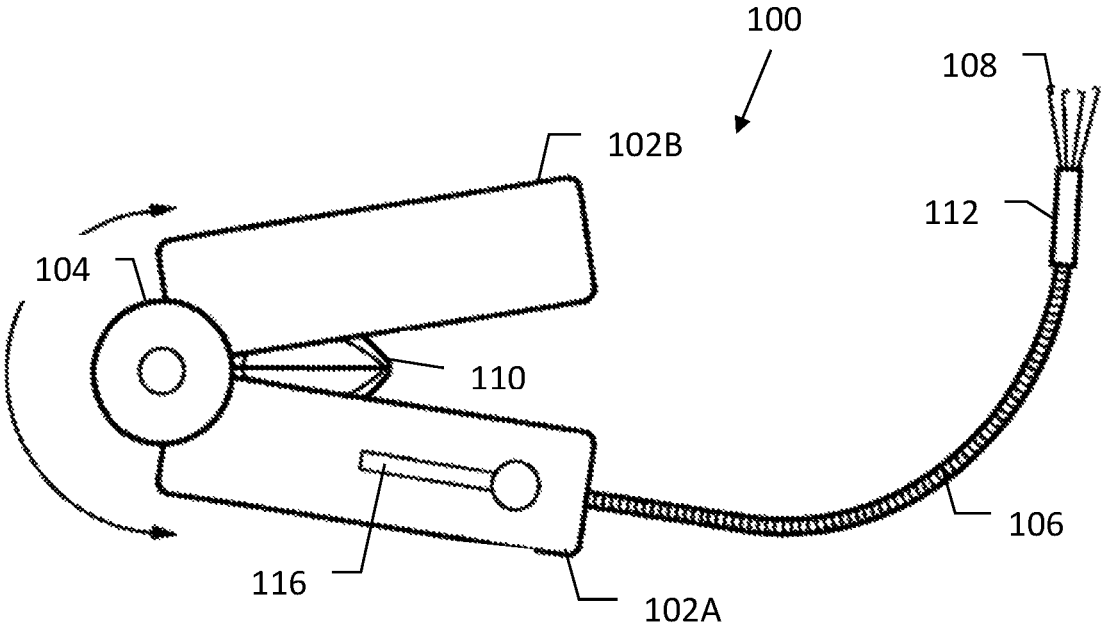
FIG. 2 is a top view of the multi-purpose tool of FIG. 1 in a partially folded state.
Figure 4:
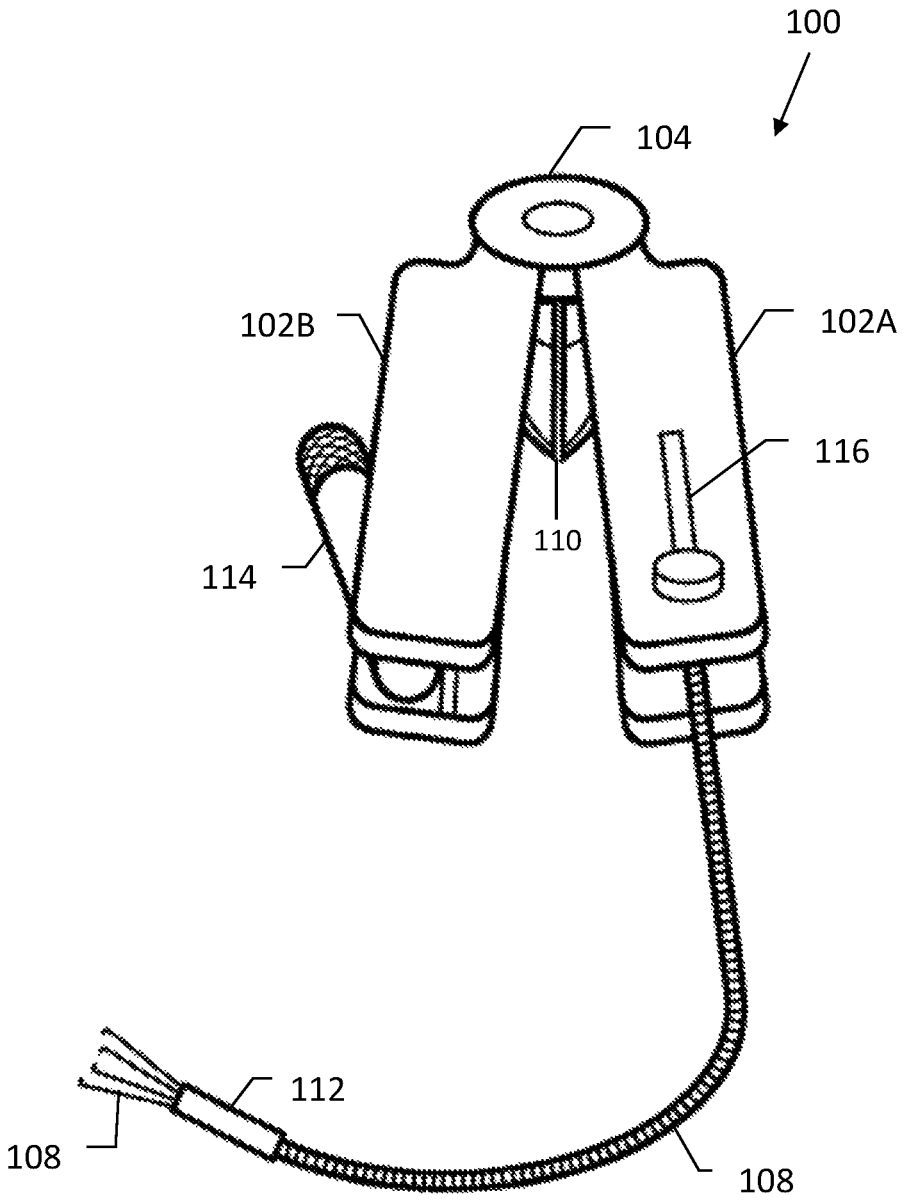
FIG. 4 is a perspective rear view of a multi-purpose tool of FIG. 1 in the partially folded state.
Figure 6:
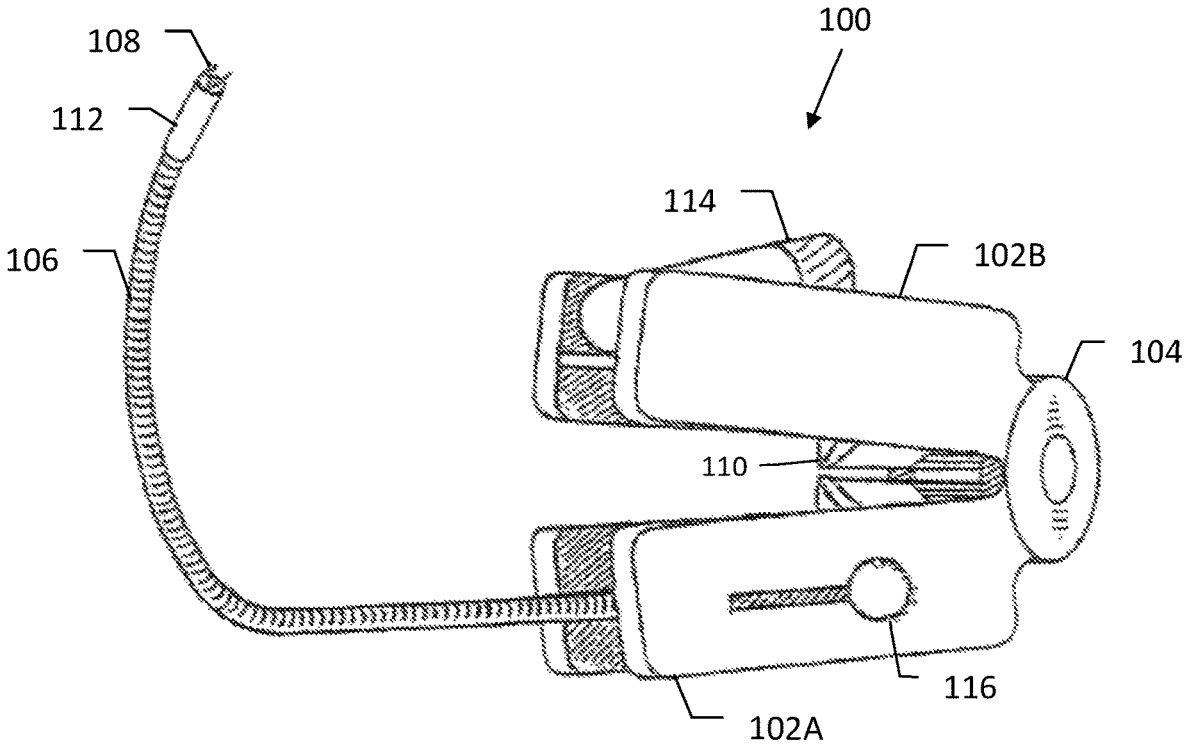
FIG. 6 is a perspective top view of the multi-purpose tool of FIG. 1 in the partially folded state.
Figure 7:
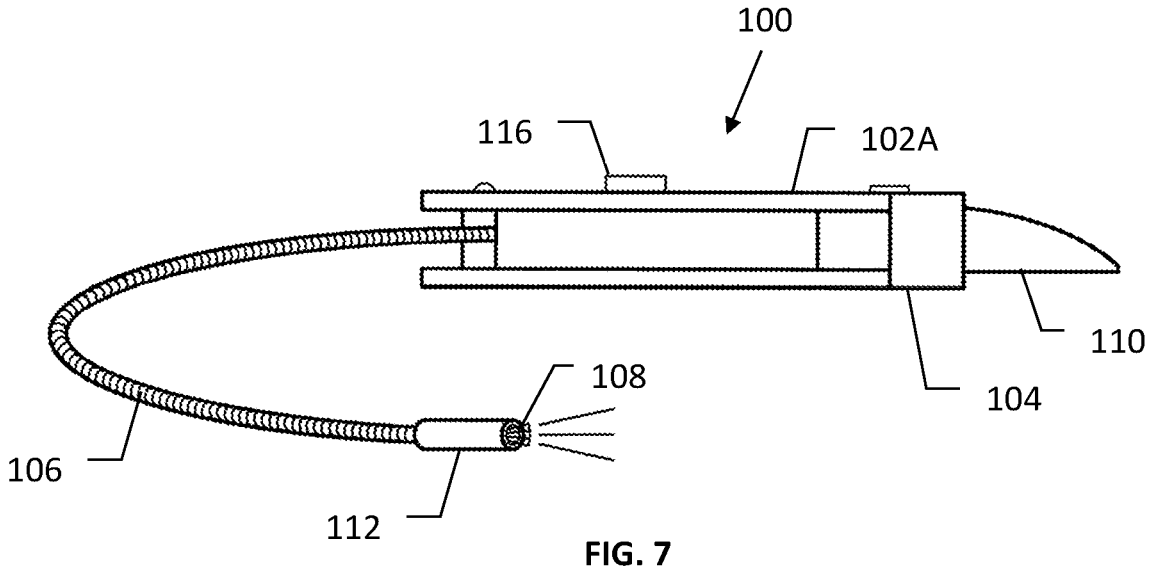
FIG. 7 is a side view of the multi-purpose tool of FIG. 1 in an unfolded state.
Figure 8:
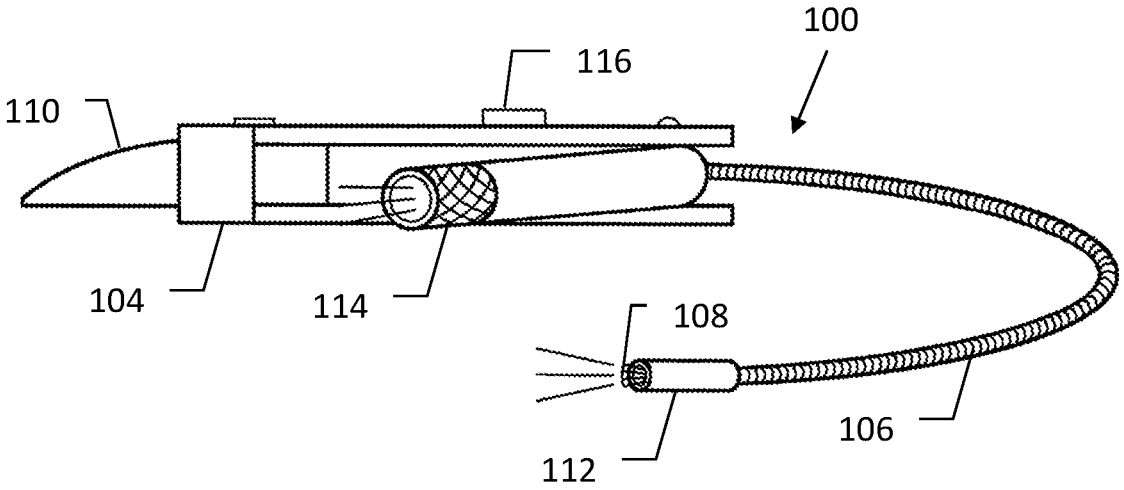
FIG. 8 is another side view of the multi-purpose tool of FIG. 1 in an unfolded state.

The multi-purpose tool 100 is foldable. Each of the two elongated handles 102A and 102B can rotate around the pivot joint 104 by 180 degrees. In a folded state, as shown in FIGS. 2, 4 and 6, the two elongated handles 102A and 1026 are positioned on the same side of the pivot joint 104 as the head portion 110. The head portion 110 is recessed between the two elongated handles 102A and 102B. For clarity of illustration, the handles 120A and 102B are not completely folded in FIGS. 2, 4 and 6. In the completely folded position, the handles 102A and 1026 would be in contact, such that the head portion 110 is completely enclosed therebetween.

Figure 3:
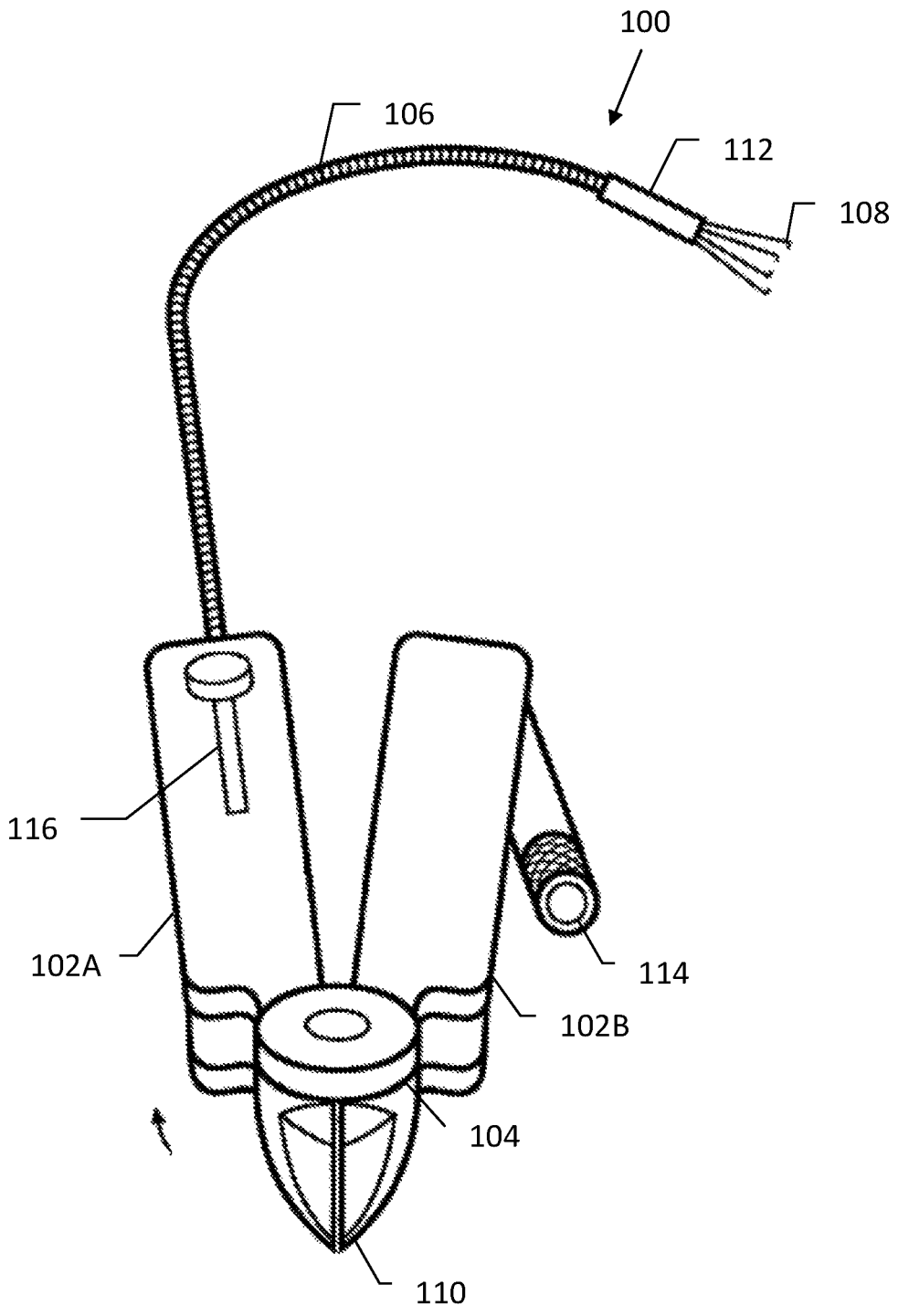
FIG. 3 is a perspective front view of the multi-purpose tool of FIG. 1 in the unfolded state.
Figure 5:
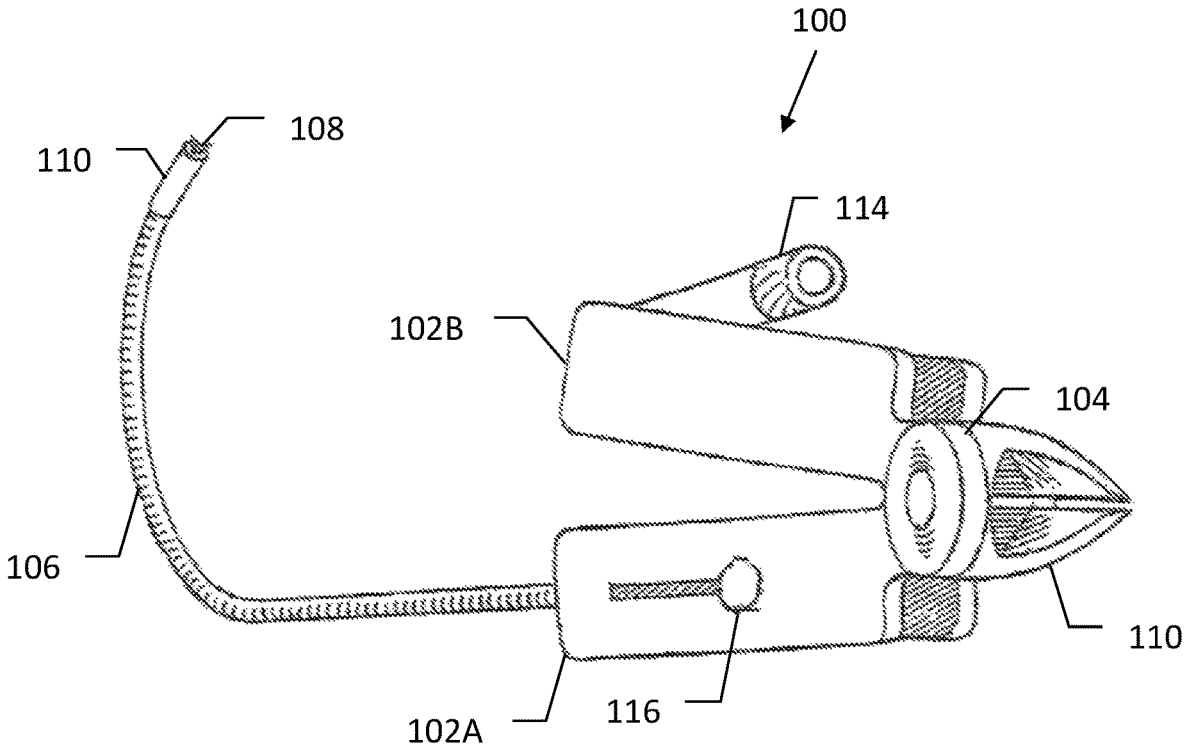
FIG. 5 is a perspective top view of the multi-purpose tool of FIG. 1 in an unfolded state.

The gripping element 108 can be used in the folded or unfolded states. In an unfolded state, as shown in FIGS. 1, 3 and 5, the two elongated handles 102A and 1026 are positioned on the opposite side of the pivot joint 104 from the head portion 110. The head portion 110 is available for use in the unfolded state, with a cutting motion of the head portion 110 accomplished by pivoting the handles 102A, 102B.

The two elongated handles 102A and 102B are sized and shaped to be easily grasped by a user's hand. For example, the handles 102A and 102B can be constructed with complex curves and surface textures made from molded or formed metal, plastics, other appropriate materials, or combinations thereof. Referring to FIGS. 3-6, in the depicted embodiment, the two elongated handles 102A and 1026 each comprises a pair of planner elements with a corresponding aperture and in between. The pair of planner elements in each elongated handle are generally parallel to each other. In this scenario, the head portion 110 can be recessed inside the apertures of the elongated handles 102A and 1026 when the multi-purpose tool 100 is in the folded state.

A first lighting element 112 in preferably installed in the distal end of the tubular element 106. The first lighting element 112 can be automatically turned on when the gripping element 108 is extended outwardly from the distal end of the tubular element 106 and automatically turned off when the gripping element 108 is retracted into the distal end. A rotatable second lighting element 114 is mounted on one of the two elongated handles 102A and 1026. Advantageously, the second lighting element 114 is mounted on a different handle from the first lighting element 112.

A mechanical (e.g., actuation) mechanism controls the gripping element 108 between an open state and a closed state. For example, the gripping element 108 is connected to the slide 116 via a cable arm affixed inside the flexible tubular element 106. As the slide 116 is moved forward, the gripping element 110 protrudes and opens from the distal end of the flexible tubular element 106 in order to grab an object. In one embodiment, when the slide 116 is moved backward half way, the gripping element 110 closes and secures the object within the gripping element 110. When the slide 116 moves backward all the way, the object is released and the gripping element 110 is retracted within the distal end of the elongated handle 102A. The cable arm can be made of braided metal, plastic resilient, or a combination thereof.

The head portion 110 includes one or more cutting tools, such as a scissor or the like, to sever an object by a scissor-like action between a pair of blades or by any other cutting action. For example, the cutting tool can sever a fastener such as a zip tie. The cutting tool can have a sharp or serrated blade.

The multi-purpose tool 100 can have many different appearances and configurations. The multi-purpose tool 100 can be composed of a variety of materials, including metals, alloys, plastics, or any other material that is sufficiently rigid so as to withstand normal wear and tear during use of the multi-purpose tool 100 and at the same time lightweight for easy handling and transportation.

Figure 9:
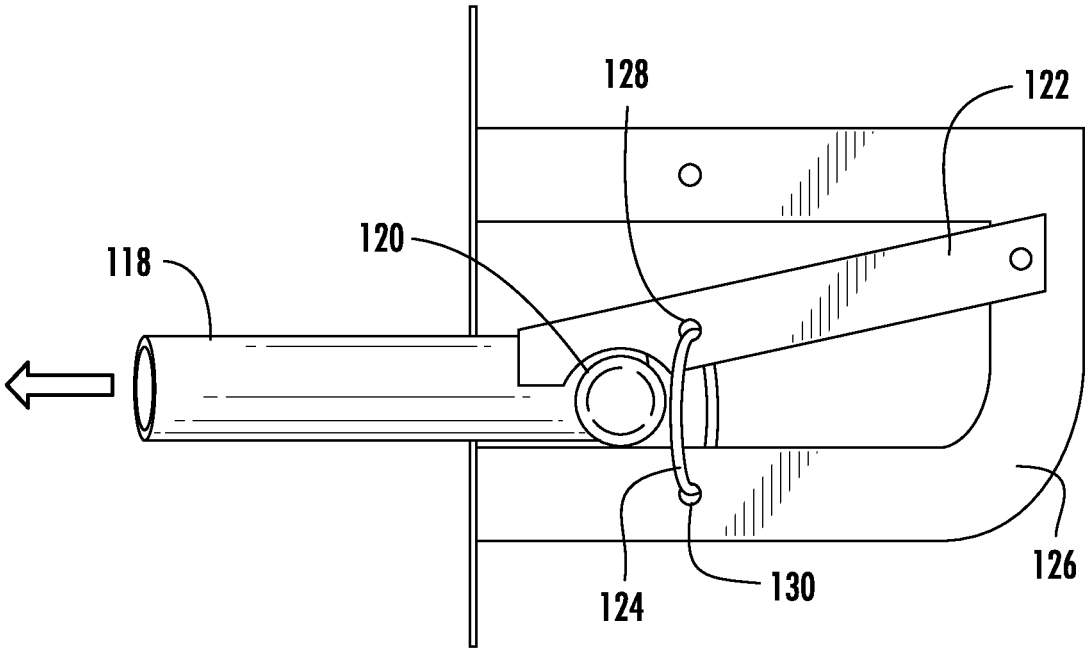
FIG. 9 is a side view of working environment of a locking fastener with a locking rod and a locking lever engaged. The locking fastener can be secured using the multi-purpose tool of FIG. 1.

In one embodiment, the multi-purpose tool 100 can be used to secure locking fasteners or other objects. Referring to FIG. 9, a handle 118 of a locking rod 120 is engaged with the locking lever 122. The handle 118 of the locking rod 120 is oriented by an approximately 90 degree rotation from the locking rod 120 and may have a cylindrical shape. The locking lever 122 includes a notch that is configured to receive and prevent the handle 118 from moving backwards out of the intermodal container (to the right in FIG. 9) once the locking lever 122 is engaged. After the locking lever 122 is engaged with the handle 118, a zip tie 124 is used to prevent the locking lever 122 from moving upward and secure the locking lever 122 down to the truck chassis 126.

To install the zip tie 124, an end of the zip tie 124 is passed through a first aperture 128 in the locking lever 122. The multi-purpose tool 100 is then used to pull the end of the zip tie 122 back through a second aperture 130 disposed in the truck chassis 126. Specifically, the flexible tubular element 106 of the multi-purpose tool 100 is inserted through the second aperture 130. A user then extends and opens the gripping element 108 outwardly from the distal end of the flexible tubular element 106. The first lighting element 112 is turned on automatically to illuminate the working area. The second lighting element 114 can also be turned on if needed. Once the gripping element 108 has gripped the end of zip tie 124, the flexible tubular element 106 is pulled back through the second aperture 130 along with the end of the zip tie 124. The zip tie 124 can then be fixedly secured into a loop around the locking lever 122 and the chassis 126. When the container arrives at the desired location, the zip tie 124 can be opened with the cutting tool in the head portion 110 of the multi-purpose tool 100.

Figure 10:
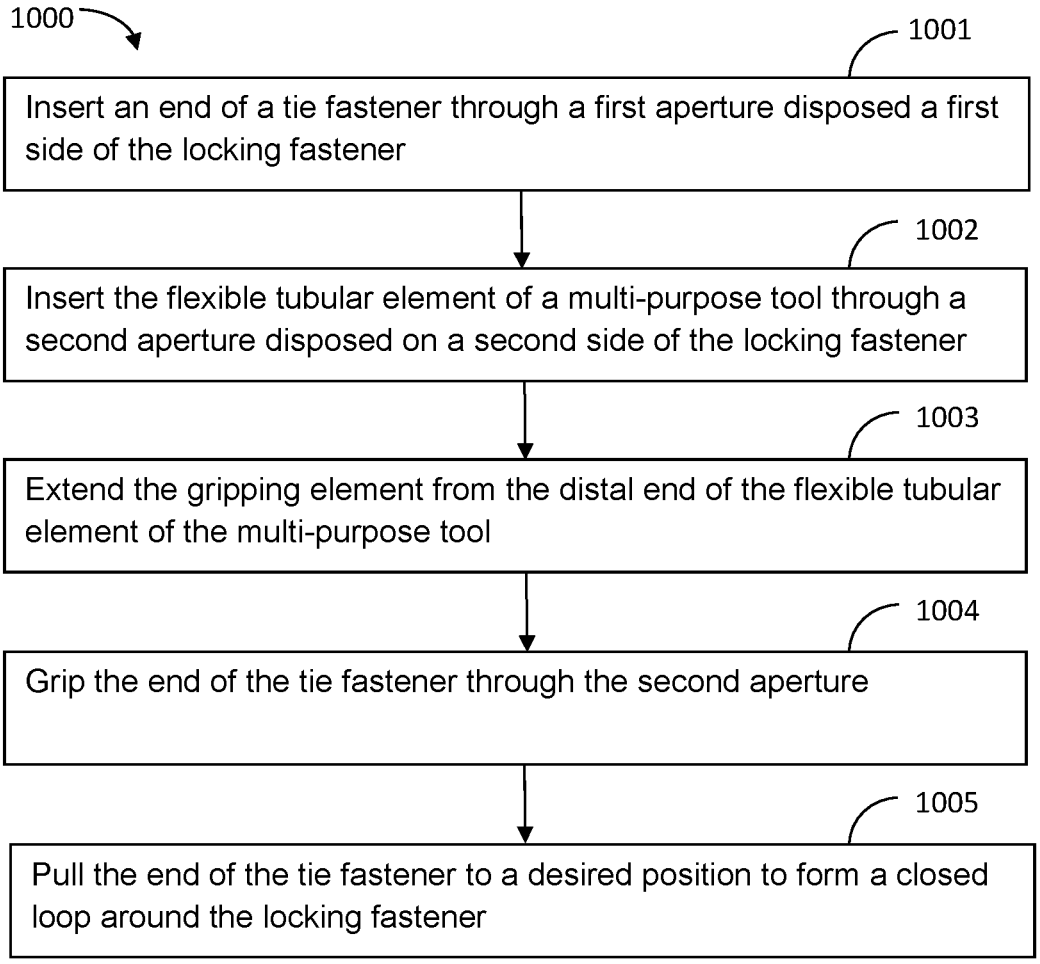
FIG. 10 is a flow diagram of a particular embodiment of a method for securing a locking fastener.

Referring now to FIG. 10, a flow diagram of an example method 1000 of securing a locking fastener using the multi-purpose tool 100. At 1001, an end of a tie fastener (e.g., zip tie 124) is inserted through a first aperture 128 disposed on a first side of a locking fastener (e.g., locking lever 122), where the locking fastener (e.g., locking lever 122) is used to secure a locking rod 120 of a truck in a locked position. At 1002, the flexible tubular element 106 of the multi-purpose tool 100 is inserted through a second aperture 130 disposed on a second side of locking fastener (e.g., locking lever 122). At 1003, a slide 116 on the multi-purpose tool 100 is manipulated (e.g., pushed forward) to extend and open the gripping element 108 outwardly from the distal end of the tubular element 106. At 1004, the slide 116 is manipulated (e.g. pushed backward) to close and grip on the end of the zip tie 124. At 1005, the end of the tie fastener (e.g., zip tie 124) is pulled back through the second aperture 130 to a desired position to form a closed loop around the locking fastener (e.g., locking lever 122). A cutting tool on the head portion 110 of the multi-purpose tool is used to cut the tie fastener (e.g., zip tie 124) when needed.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within.

What is claimed is:

1. A method of securing a locking fastener using a multi-purpose tool and a tie fastener, wherein said multi-purpose tool including two elongated handles and a head portion pivotably connected about a common pivot joint, a flexible tubular element connected to one of the two elongated handles, and a gripping element housed within a distal end of the tubular element, said method comprising:

inserting an end of a tie fastener through a first aperture disposed a first side of the locking fastener;

inserting the flexible tubular element of the multi-purpose tool through a second aperture disposed on a second side of the locking fastener;

extending the gripping element from the distal end of the flexible tubular element;

gripping the end of the tie fastener through the second aperture; and pulling the end of the tie fastener to a desired position to form a closed loop around the locking fastener.

2. The method of claim 1, wherein the locking fastener is used to secure a locking rod of a truck in a locked position.

3. The method of claim 1, further comprising turning on a first lighting element housed within the distal end of the tubular element.

4. The method of claim 1, further comprising turning on a second lighting element rotatably attached to one of the two elongated handles of the multi-purpose tool.

5. The method of claim 1, further comprising severing the closed loop to release the locking fastener via the head portion of the multi-purpose tool.

6. The method of claim 1, further comprising retracting the gripping element to the distal end of the tubular element of the multi-purpose tool.

7. The method of claim 6, further comprising rotating two elongated handles around the common pivot join to the same side of the head portion to fold the multi-purpose tool.

8. The method of claim 1, wherein the tie fastener is a zip tie.

* * * * *